US005600338A

United States Patent [19]

Ecklund et al.

[11] Patent Number: 5,600,338

[45] Date of Patent: Feb. 4, 1997

[54] COAXIAL-COLLINEAR ANTENNA

[75] Inventors: Warner L. Ecklund, Boudler; John W. Neuschaefer, Lafayette, both of Colo.

[73] Assignee: Radian Corporation, Austin, Tex.

[21] Appl. No.: 394,847

[22] Filed: Feb. 27, 1995

[51] Int. Cl.[6] ..... H01Q 1/16

[52] U.S. Cl. ..... 343/790; 343/791; 343/792; 343/905

[58] Field of Search ..... 343/790, 791, 343/792, 821, 822, 905, 906; 174/75 C, 88 C, 99 R, 138 A, 138 R; H01Q 1/14, 1/16

[56] References Cited

U.S. PATENT DOCUMENTS

| | | | |
|---|---|---|---|
| 3,031,668 | 8/1956 | Bryson | 343/790 |
| 4,937,588 | 6/1990 | Austin | 343/791 |
| 5,105,199 | 4/1992 | Ukmar | 343/791 |
| 5,140,336 | 8/1992 | Suomi | 343/790 |
| 5,285,211 | 2/1994 | Herper et al. | 343/791 |

*Primary Examiner*—Donald T. Hajec
*Assistant Examiner*—Tan Ho
*Attorney, Agent, or Firm*—Klauber & Jackson

[57] ABSTRACT

An improved coaxial-collinear antenna comprising a pair of continuous inner conductors each having a plurality of dielectric spacers mounted thereon for supporting a plurality of individual outer conductors in coaxial alignment with the continuous inner conductor. The outer conductors are equidistantly spaced along each continuous inner conductor by an amount substantially equal to the length of each outer conductor. The pair of continuous inner conductors are parallel, and the outer conductors mounted on each continuous inner conductor are electrically connected to the other continuous inner conductor between outer conductors consecutively mounted on that other inner conductor.

15 Claims, 7 Drawing Sheets

COAXIAL-COLLINEAR ANTENNA

FIELD OF THE INVENTION

The present invention relates to large antenna arrays and, more particularly, to an improved coaxial-collinear antenna.

DESCRIPTION OF THE PRIOR ART

Wind profiling Doppler radars use large antenna arrays typically consisting of many radiating elements located above a large horizontal ground plane. A typical array may include nearly a thousand individual radiating elements, and the phase and amplitude of the radio frequency power radiated by each element must be closely controlled for optimum performance.

A coaxial-collinear antenna simplifies the feed network for large arrays by combining radiating elements and a coaxial feed network in a simple structure so as to reduce the ratio of elements to feed points by a factor of 10 to 50. A typical coaxial-collinear antenna is made of sections of transmission line with inner and outer conductors transposed at ½ wavelength intervals. In past designs, the transmission line was commercial coaxial cable having lossy dielectric material between the inner and outer conductors. The lossy dielectric material reduced the propagation velocity in the transmission line so that the transposed sections had to be cut to lengths shorter than the ½ wavelengths in order to preserve the correct electrical phasing. The wavelength mismatch caused the radiating current distribution on the outside of the coaxial line to be non-uniform, thereby degrading antenna performance.

More recent coaxial-collinear antenna designs have substantially eliminated the presence of lossy dielectric material between the inner and outer conductors. For example, in U.S. Pat. No. 5,285,211, a coaxial-collinear antenna design is disclosed wherein a plurality of ½ wavelength coaxial sections are soldered together so as to form a coaxial-collinear antenna. This design eliminates the need for lossy dielectric material between inner and outer conductors since each ½ wavelength coaxial section comprises a pair of dielectric couplers for supporting an inner and an outer conductor at their ends. However, each dielectric coupler in this design is located at an inner and outer conductor interchange point, which is also a high voltage-high impedance point where excess dielectric can increase loss. A better location for such a dielectric coupler, or a similar dielectric spacer which centers the inner and outer conductors in an outer dielectric radome, would be at the center of the inner and outer conductor elements.

The above-described coaxial-collinear antenna design has other drawbacks. For example, the design consists of a plurality of ½ wavelength coaxial sections which must be soldered together. In contrast, manufacturing would be facilitated if continuous inner conductors were used so as to promote self-alignment. Also, the above-described design shows conventional center feeding, while nonsymmetric, off-center feeding would be preferred so as to provide flexibility. Furthermore, the above-described design shows ¼ wavelength end terminations, while a choice of various end termination designs (such as ½ wavelength) would be preferred also so as to provide flexibility. Additionally, the above-described design indicates that plastic materials may be used for the dielectric couplers and a radome, while it is commonly known that plastic is generally porous and non-UV resistant.

With the aforementioned drawbacks in mind, it would be both beneficial and novel to provide an improved coaxial-collinear antenna which overcomes these drawbacks.

SUMMARY OF THE INVENTION

The present invention contemplates an improved coaxial-collinear antenna comprising a pair of continuous inner conductors each having a plurality of dielectric spacers mounted thereon for supporting a plurality of individual outer conductors in coaxial alignment with the continuous inner conductor. The outer conductors are equidistantly spaced along each continuous inner conductor by an amount substantially equal to the length of each outer conductor. The pair of continuous inner conductors are parallel, and the outer conductors mounted on each continuous inner conductor are electrically connected to the other continuous inner conductor between outer conductors consecutively mounted on that other inner conductor.

The improved coaxial-collinear antenna also comprises dielectric supports for supporting a radome around the connected pair of continuous inner conductors and their associated dielectric spacers and outer conductors. These dielectric supports are mounted along the improved coaxial-collinear antenna at the center of the outer conductors so as to insure minimal loss.

Accordingly, the primary objective of the present invention is to provide an improved coaxial-collinear antenna that effectively eliminates the presence of lossy dielectric material between inner and outer conductors, thereby effectively eliminating losses associated therewith.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now be made to the appended drawing. The drawings should not be construed as limiting the present invention but are intended to be exemplary only.

PREFERRED EMBODIMENT OF THE PRESENT INVENTION

Figure 1:
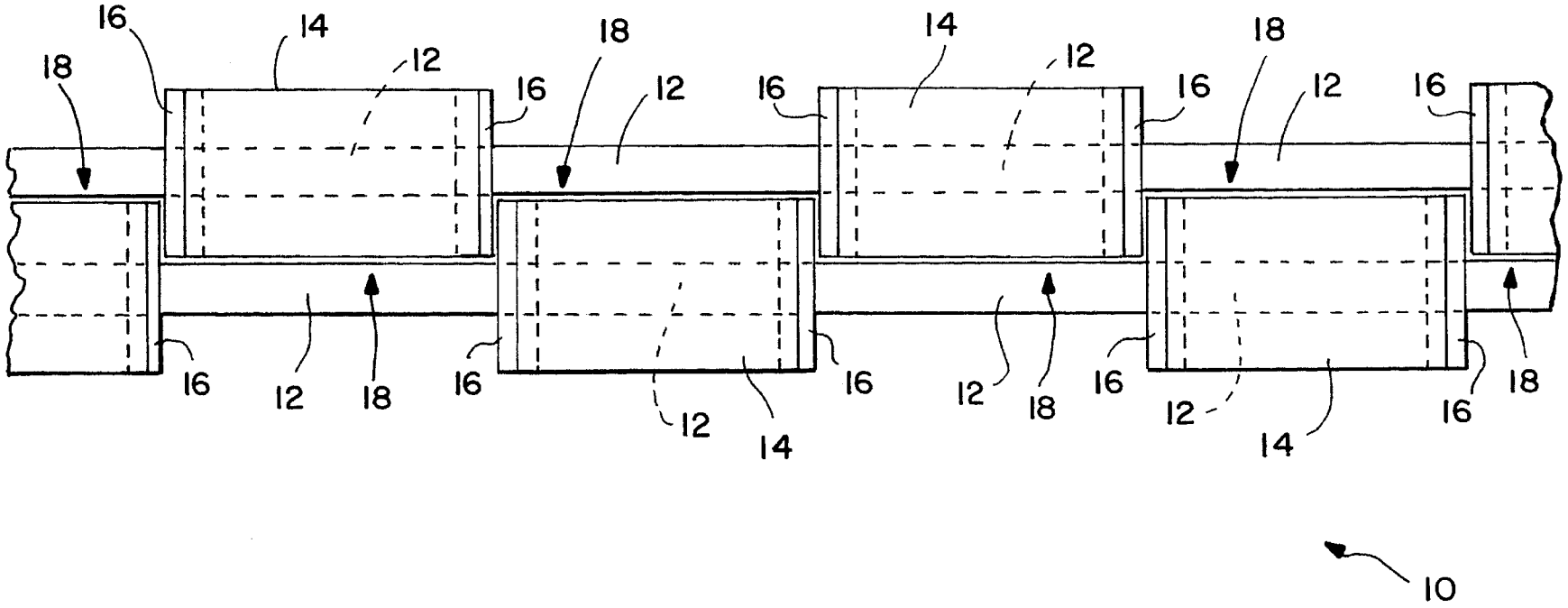
FIG. 1 is a partial top view of an improved coaxial-collinear antenna according to the present invention.

Referring to FIG. 1, there is shown a partial top view of an improved coaxial-collinear antenna 10 according to the present invention. The antenna 10 comprises a pair of continuous parallel inner conductors 12, a plurality of individual outer conductors 14, and a plurality of dielectric spacers 16. Each inner conductor 12 typically has the shape of a cylindrical tube and is typically fabricated of copper (see FIGS. 2 and 3). It should be noted, however, that each inner conductor 12 may also have the shape of a solid cylindrical rod, and may also be fabricated of brass or other conductive materials.

Figures 2, 3, 4, 5:
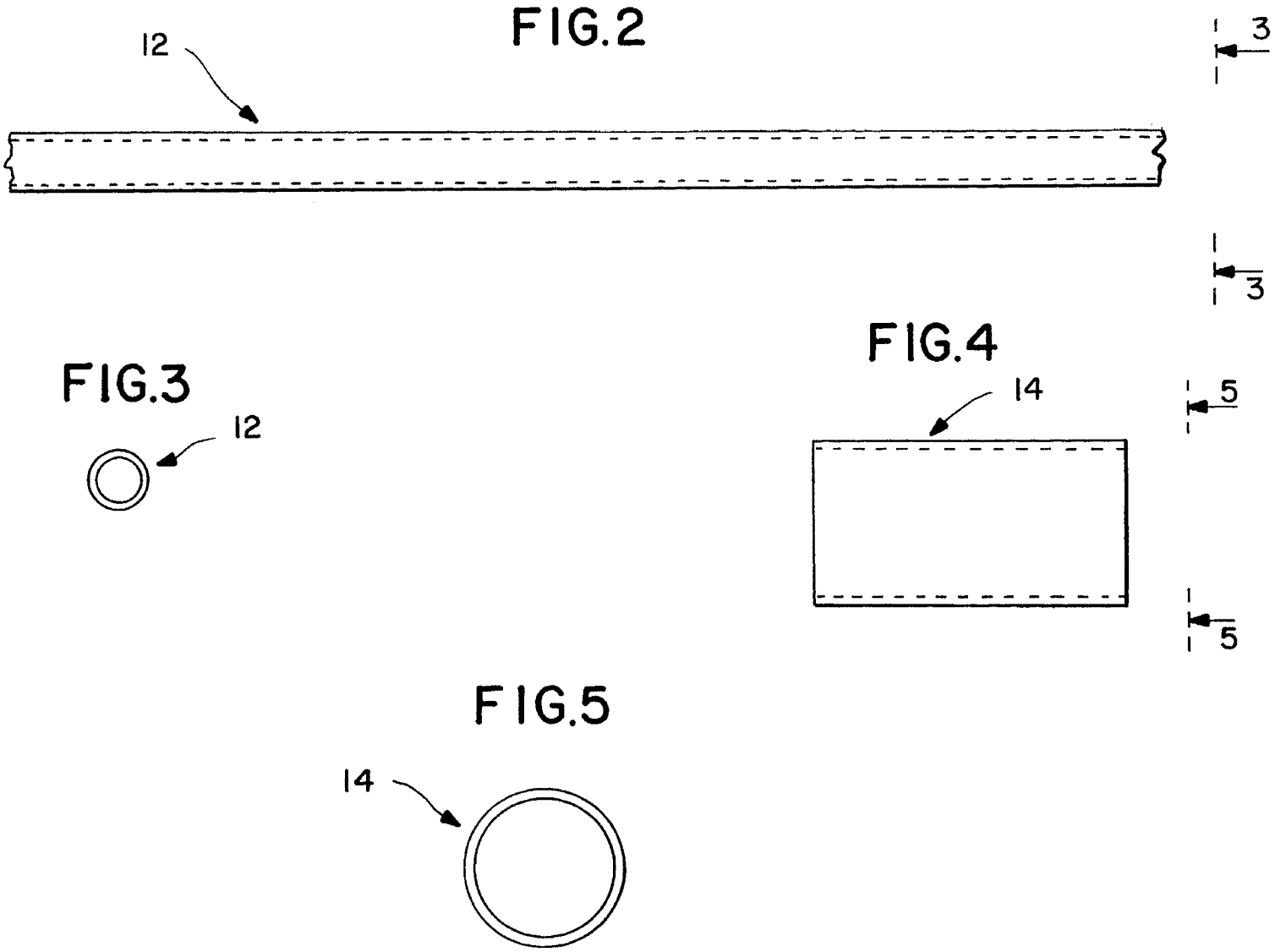
FIG. 2 is a partial side view of one of the inner conductors in the improved coaxial-collinear antenna shown in FIG. 1.
FIG. 3 is an end view of one of the inner conductors in the improved coaxial-collinear antenna shown in FIG. 1 taken along line 3—3 of FIG. 2.
FIG. 4 is a side view of one of the outer conductors in the improved coaxial-collinear antenna shown in FIG. 1.
FIG. 5 is an end view of one of the outer conductors in the improved coaxial-collinear antenna shown in FIG. 1 taken along line 5—5 of FIG. 4.

Each outer conductor 14 typically has the shape of a cylindrical tube and is typically fabricated of copper (see FIGS. 4 and 5). The length of each outer conductor 14 is substantially equal to ½ the wavelength of the operating frequency of the antenna 10. Since there is no lossy dielectric between the inner conductors 12 and the outer conductors 14 (i.e. the dielectric between the inner conductors 12 and the outer conductors 14 is air), the length of each outer conductor 14 corresponds to ½ the free space wavelength of the operating frequency of the antenna 10. It should be noted that each outer conductor 14 may also be fabricated of brass or other conductive materials.

Figure 6:
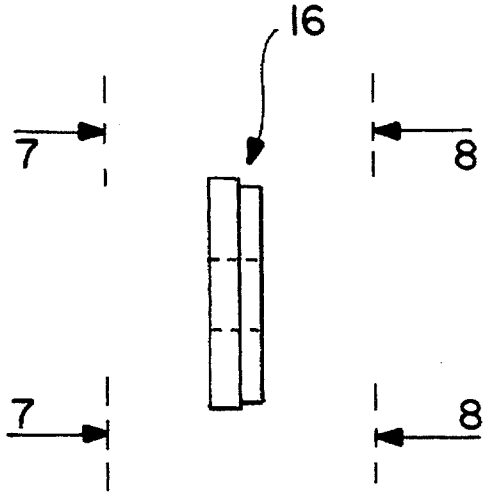
FIG. 6 is a side view of one of the dielectric spacers in the improved coaxial-collinear antenna shown in FIG. 1.
Figure 7:
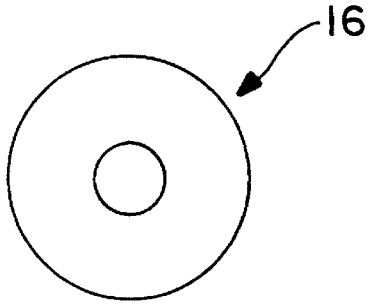
FIG. 7 is an end view of one of the dielectric spacers in the improved coaxial-collinear antenna shown in FIG. 1 taken along line 7—7 of FIG. 6.
Figure 8:
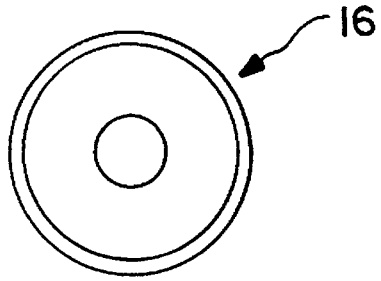
FIG. 8 is an end view of one of the dielectric spacers in the improved coaxial-collinear antenna shown in FIG. 1 taken along line 8—8 of FIG. 6.

Each dielectric spacer 16 has the shape of a substantially flat disc with an aperture formed through the center thereof (see FIGS. 6–8). The diameter of the aperture is substantially equal to the outer diameter of an inner conductor 12 so as to allow each dielectric spacer 16 to fit snugly around an inner conductor 12. The outer diameter of each dielectric spacer 16 is stepped so as to allow a first portion of the spacer to fit snugly within an outer conductor 14 while a second portion of the spacer sits flush with or slightly below the outer diameter of an outer conductor 14. The benefit of having such a stepped outer diameter is to prevent the entire dielectric spacer 16 from being fit within an outer conductor 14. Thus, access is always provided to the second portion of each dielectric spacer 16 so as to enable easy removal of each dielectric spacer 16 from within an outer conductor 14. Furthermore, the second portion of each dielectric spacer 16 acts to electrically isolate the ends of adjacent outer conductors 14 since they are positioned with their ends substantially abutting each other. It should be noted, however, that the outer diameter of each dielectric spacer 16 may alternatively be uniform so as to allow the entire dielectric spacer 16 to be fit within an outer conductor 14, but special care must be taken to electrically isolate the ends of adjacent outer conductors 14.

Each dielectric spacer 16 is typically fabricated of teflon because of its tolerance of high temperatures. It should be noted, however, that the dielectric spacers 16 may also be fabricated of other dielectric materials.

Referring again to FIG. 1, each inner conductor 12 has a plurality of the dielectric spacers 16 fit thereon and consecutive pairs of the dielectric spacers 16 have outer conductors 14 fit therebetween. Thus, each inner conductor 12 has a plurality of outer conductors 14 aligned coaxially therewith so that the outer conductors 14, as well as the dielectric spacers 16, associated with each inner conductor 12 are also collinear.

The consecutive pairs of dielectric spacers 16 and their associated outer conductors 14 are equidistantly spaced along the inner conductors 12 by an amount substantially equal to their own length. This spacing allows a consecutive pair of dielectric spacers 16 and their associated outer conductor 14 on each inner conductor 12 to fit between a first consecutive pair of dielectric spacers 16 and their associated outer conductor 14 and a second consecutive pair of dielectric spacers 16 and their associated outer conductor 14 on the other inner conductor 12. Due to the coaxial and collinear characteristics of the inner conductors 12 and their associated dielectric spacers 16 and outer conductors 14, the outer conductors 14 on each inner conductor 12 are tangent to the other inner conductor 12. Thus, each outer conductor 14 on each inner conductor 12 is electrically connected to the other inner conductor 12. The electrical connection is typically made by a solder joint 18 along the line where the inner conductors 12 and outer conductors 14 tangentially meet. It should be noted that other rigid conductive materials may also be utilized to join the inner conductors 12 and outer conductors 14.

Figure 9:
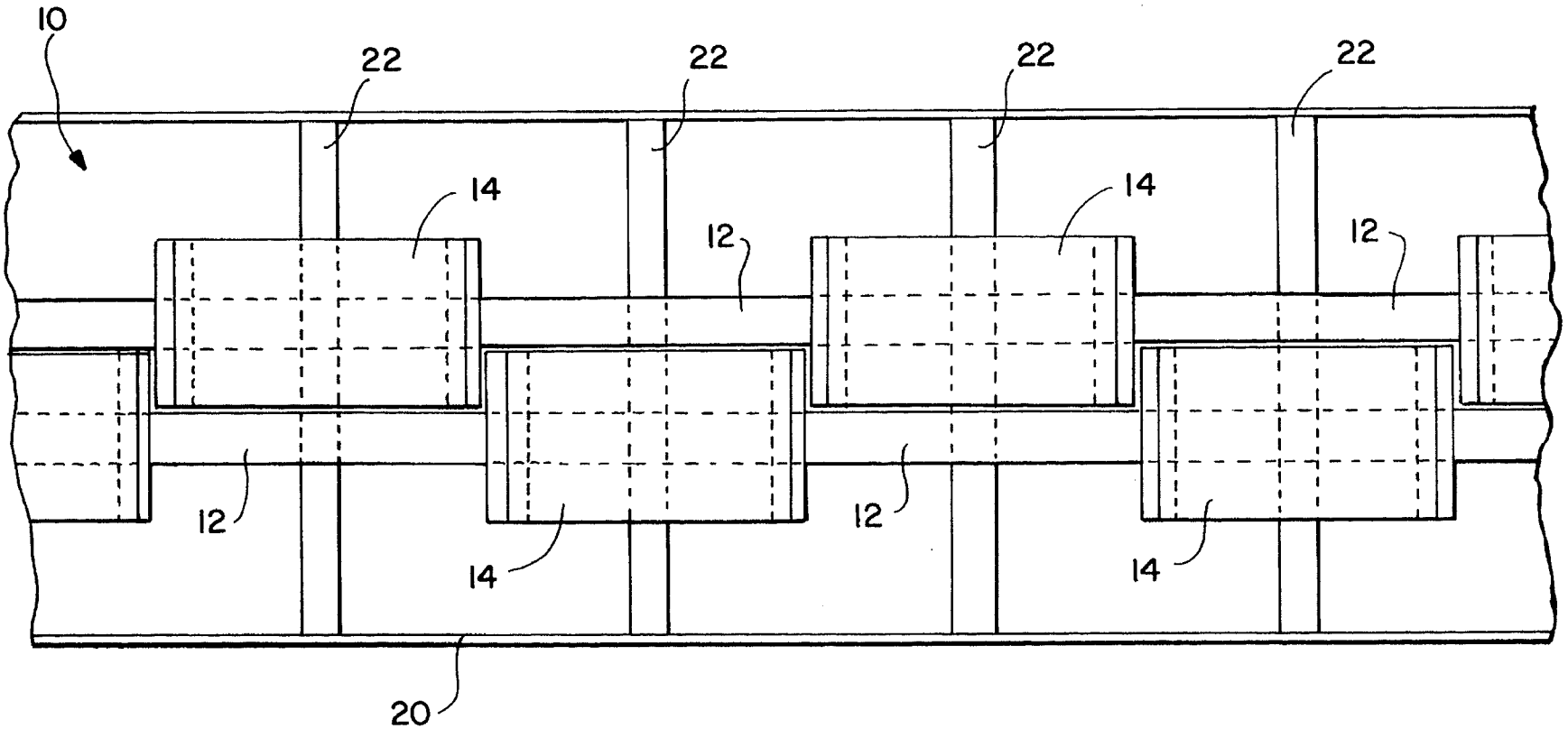
FIG. 9 is a partial top view of the improved coaxial-collinear antenna shown in FIG. 1 along with a radome and dielectric supports shown in cross-section.

Referring to FIG. 9, there is shown a radome 20 and dielectric supports 22 enclosing the improved coaxial-collinear antenna 10. The dielectric supports 22 are shaped to fit snugly around the inner conductors 12 and the outer conductors 14 so as to support the radome 20 thereabout. It is important to note that the dielectric supports 22 are positioned at the center of each outer conductor 14, which is a low voltage-low impedance point. This center positioning of the dielectric supports 22 minimizes any losses associated with the presence of the dielectric material. It is also important to note that the dielectric supports 22 are shaped so as to insure that the inner conductors 12 and the outer conductors 14 are centered within the radome 20 so as to minimize any losses.

Figure 10:
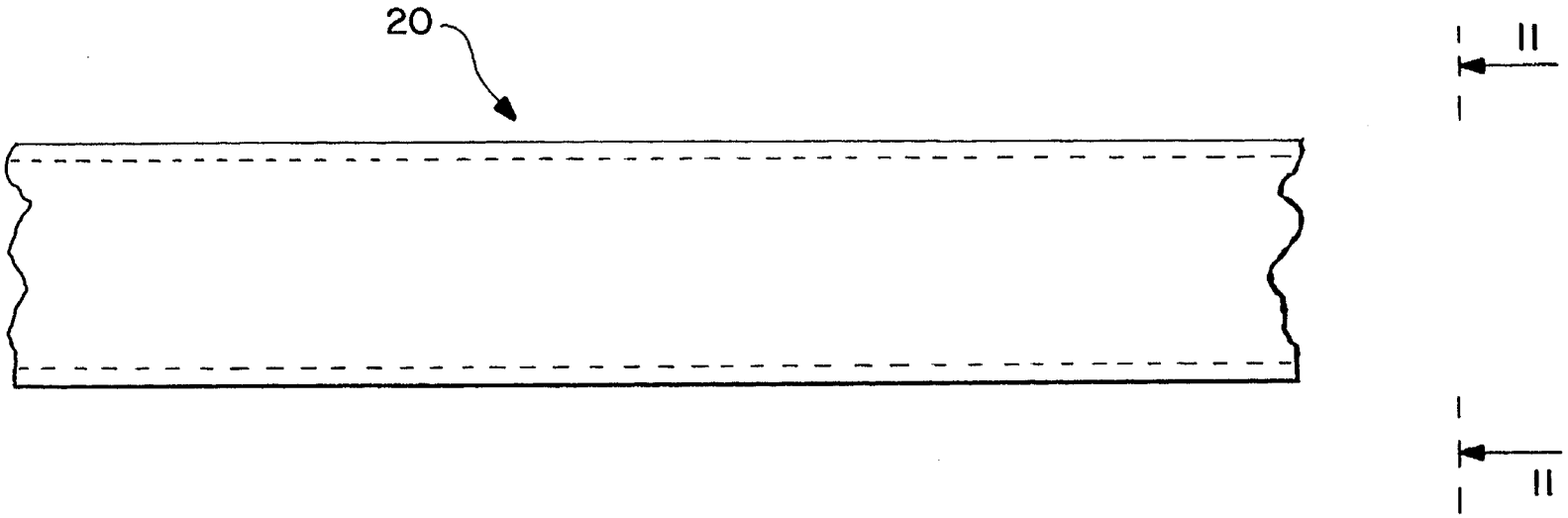
FIG. 10 is a side view of the radome accompanying the improved coaxial-collinear antenna shown in FIG. 9.
Figure 11:
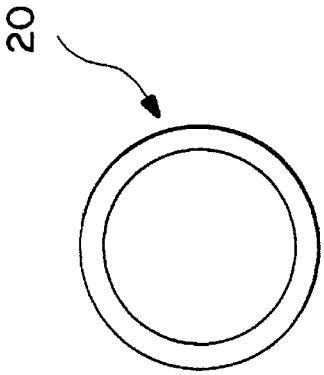
FIG. 11 is an end view of the radome accompanying the improved coaxial-collinear antenna shown in FIG. 9 taken along line 11—11 of FIG. 10.

The radome 20 typically has the shape of a cylindrical tube and is typically fabricated of fiberglass (see FIGS. 10 and 11). It should be noted, however, that the radome 20 may also be fabricated of other dielectric materials having the desirable qualities of fiberglass (i.e. non-porous, UV resistant, and rigid).

Figure 13:
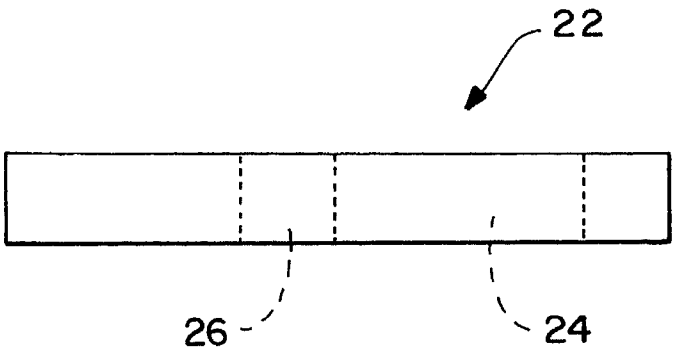
FIG. 13 is a side view of one of the dielectric supports accompanying the improved coaxial-collinear antenna shown in FIG. 9 taken along line 13—13 of FIG. 12.
Figure 12:
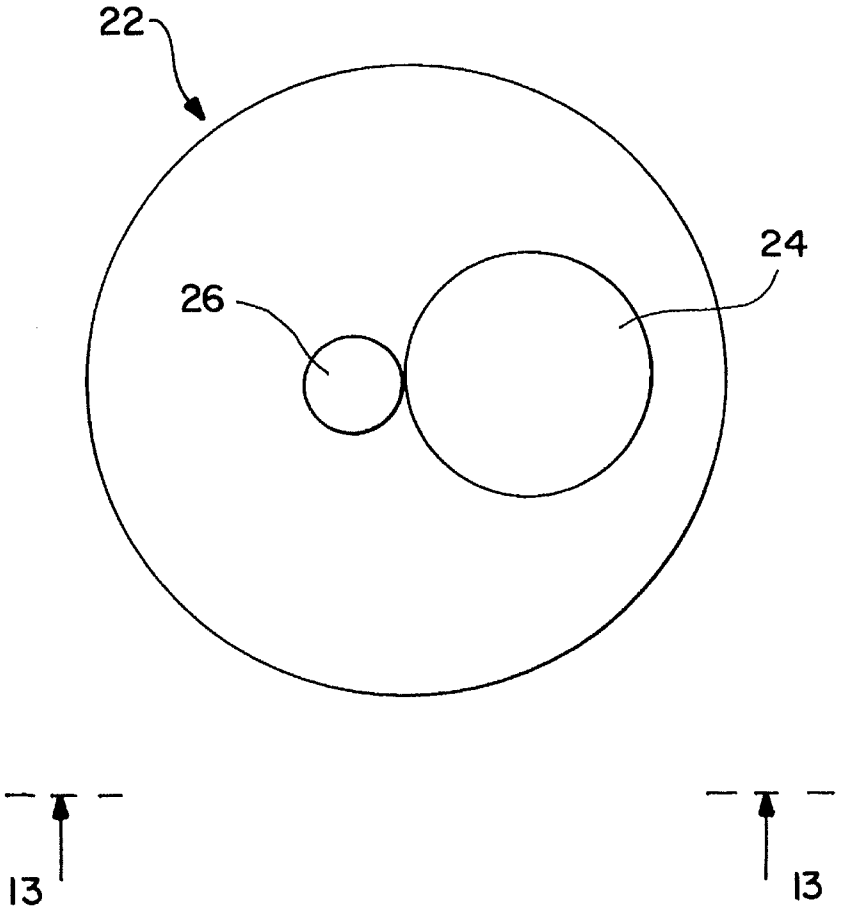
FIG. 12 is an end view of one of the dielectric supports accompanying the improved coaxial-collinear antenna shown in FIG. 9.

Each dielectric support 22 has the shape of a substantially flat disc with a relatively large aperture 24 and a relatively small aperture 26 formed therethrough (see FIGS. 12 and 13). The diameter of the large aperture 24 is substantially equal to the outer diameter of an outer conductor 14 so as to allow each dielectric support 22 to fit snugly around an outer conductor 14. The diameter of the small aperture 26 is substantially equal to the outer diameter of an inner conductor 12 so as to allow each dielectric support 22 to fit snugly around an inner conductor 12. The diameters of the large aperture 24 and the small aperture 26 are tangential such that when the inner conductors 12 and the outer conductors 14 are tangentially connected together, the dielectric supports 22 maintain the tangential connection.

The outer diameter of each dielectric support 22 is substantially equal to the inner diameter of the radome 20 so as to allow the radome 20 to fit snugly around the dielectric support 22. As previously mentioned, it is important that the dielectric supports 22 keep the inner conductors 12 and the outer conductors 14 centered within the radome 20 so as to minimize any losses.

Each dielectric support 22 is typically fabricated of teflon because of its tolerance of high temperatures. It should be noted, however, that the dielectric supports 22 may also be fabricated of other dielectric materials.

Figure 14:
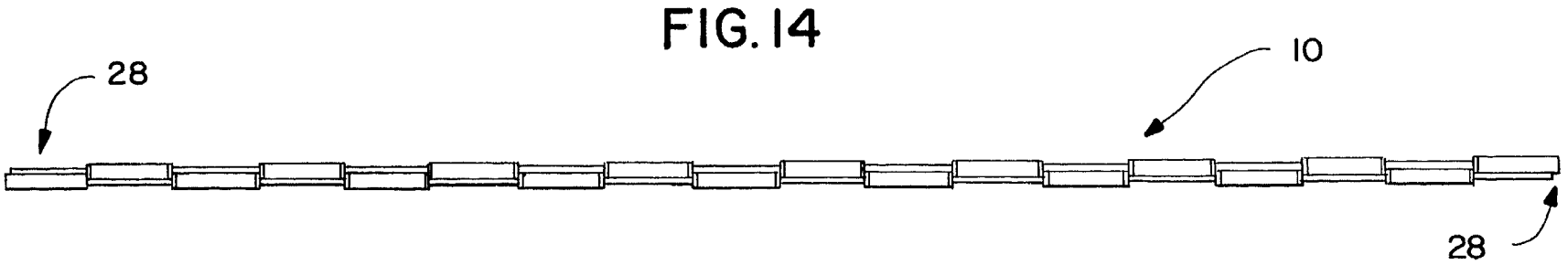
FIG. 14 is a top view of an improved coaxial-collinear antenna according to the present invention.

Referring to FIG. 14, there is shown a top view of an improved coaxial-collinear antenna 10 according to the present invention. The ends 28 of the improved coaxial-collinear antenna 10 are tuned so as to maintain a voltage maximum and a current minimum at each end 28 for a particular frequency of operation. This tuning is accomplished by constructing a ½ wavelength termination, a ¼ wavelength termination, or any of a number of other conventional termination schemes at each end 28 of the improved coaxial-collinear antenna 10. The important point to note here is that the improved coaxial-collinear antenna 10 is not limited to any one particular termination scheme.

Figure 15:
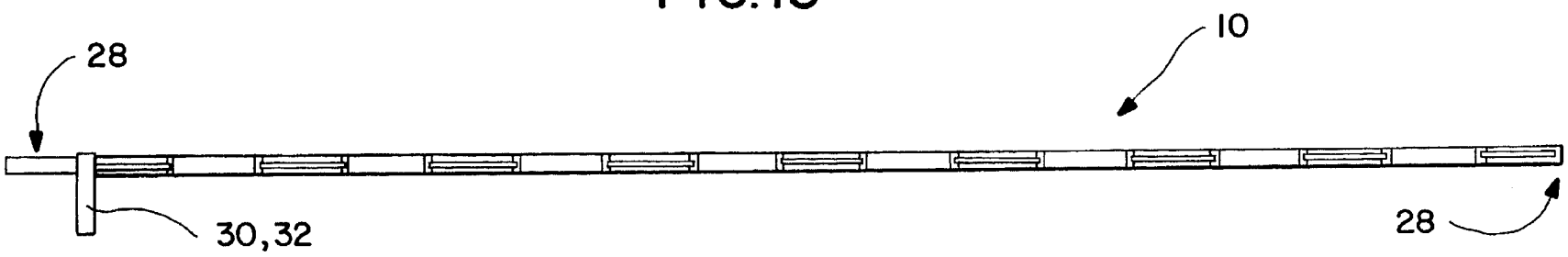
FIG. 15 is a side view of an improved coaxial-collinear antenna 10 according to the present invention along with an antenna feed and balun.

Referring to FIG. 15, there is shown a side view o:f an improved coaxial-collinear antenna 10 according to the present invention along with an antenna feed 30 and balun 32. The antenna feed 30 comprises a pair of feed cables which make electrical contact between the balun 32 and either an inner conductor 12 or an outer conductor 14 in each coaxial-collinear line. The balun 32 is a common impedance matching device that is known to those skilled in the art and therefore will not be described further.

As shown in FIG. 15, the antenna led 30 is located at a conductor interchange close to one end of the antenna 10. The location of the antenna fed 30, however, is not limited to the location shown in FIG. 15. In fact, the antenna fed 30 may be located at any conductor interchange along the improved coaxial-collinear antenna 10. Thus, the important point to note here is that the location of the antenna feed 30 on the improved coaxial-collinear antenna 10 is not limited to any one particular conductor interchange.

Figure 16:
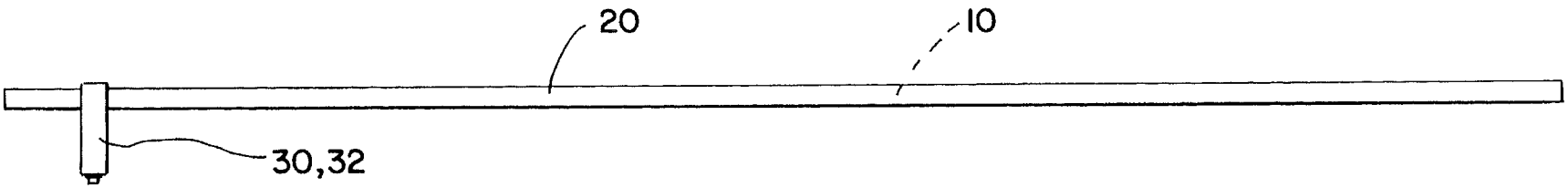
FIG. 16 is a side view of an improved coaxial-collinear antenna according to the present invention enclosed within a radome and connected to a balun through an antenna feed.

Referring to FIG. 16, there is shown a side view of an improved coaxial-collinear antenna 10 according to the present invention enclosed within a radome 20 and connected to a balun 32 through an antenna feed 30. This is the typical condition in which the improved coaxial-collinear antenna 10 operates.

With the present invention coaxial-collinear antenna 10 now fully described, it can thus be seen that the primary objective set forth above is efficiently attained and, since certain changes may be made in the above-described antenna 10 without departing from the scope of the invention, it is intended that all matter contained in the above description or shown in the accompanying drawings shall be interpreted as illustrative and not in a limiting sense.

What is claimed is:

1. An improved coaxial-collinear antenna comprising:

a first continuous inner conductor having a first plurality of individual outer conductors aligned coaxially therewith, each said outer conductor in said first plurality of outer conductors being equidistantly spaced along said first continuous inner conductor by an amount substantially equal to the length of one of said outer conductors; and a second continuous inner conductor having a second plurality of individual outer conductors aligned coaxially therewith, each said outer conductor in said second plurality of outer conductors being equidistantly spaced along said second continuous inner conductor by an amount substantially equal to the length of one of said outer conductors;

said first and second continuous inner conductors being parallel, each said outer conductor in said first plurality of outer conductors being electrically connected to said second continuous inner conductor between consecutively spaced outer conductors in said second plurality of outer conductors, each said outer conductor in said second plurality of outer conductors being electrically connected to said first continuous inner conductor between consecutively spaced outer conductors in said first plurality of outer conductors.

2. The improved coaxial-collinear antenna defined in claim 1, further comprising a first and a second plurality of dielectric spacers, wherein said first plurality of dielectric spacers are disposed between said first continuous inner conductor and said first plurality of outer conductors so as to provide coaxial alignment therebetween, and wherein said second plurality of dielectric spacers are disposed between said second continuous inner conductor and said second plurality of outer conductors so as to provide coaxial alignment therebetween.

3. The improved coaxial-collinear antenna defined in claim 2, wherein said first and second pluralities of dielectric spacers comprise annularly shaped dielectric discs each having an aperture formed through the center thereof wherein the diameter of each aperture is substantially equal to the outer diameters of both said first continuous inner conductor and said second continuous inner conductor so as to allow each said annular disc to fit snugly around said inner conductors.

4. The improved coaxial-collinear antenna defined in claim 3, wherein the outer diameter of each said annularly shaped dielectric disc is substantially equal to the inner diameters of said outer conductors in both said first plurality of outer conductors and said second plurality of outer conductors so as to allow each said annular disc to fit snugly within said outer conductors.

5. The improved coaxial-collinear ante ma defined in claim 3, wherein each said annularly shaped dielectric disc has a stepped outer diameter, wherein a first portion of each said annular disc has an outer diameter that is substantially equal to the inner diameters of said outer conductors in both said first plurality of outer conductors and said second plurality of outer conductors so as to allow said first portion of each said annular disc to fit snugly within said outer conductors, and wherein a second portion of each said annular disc has an outer diameter that is substantially equal to or less than the outer diameters of said outer conductors in both said first plurality of outer conductors and said second plurality of outer conductors so as to allow said second portion of each said annular disc to sit flush with or below the outer diameters of said outer conductors and thereby allow said outer conductors to be tangentially electrically connected to said inner conductors.

6. The improved coaxial-collinear antenna defined in claim 1, further comprising a plurality of dielectric supports, wherein each said dielectric support is disposed around one of said continuous inner conductors and connected one of said outer conductors so as to sustain a tangential electrical connection between said continuous inner conductor and said one outer conductor.

7. The improved coaxial-collinear antenna defined in claim 6, wherein said plurality of dielectric supports comprise circularly shaped dielectric discs each having a first aperture and a second aperture formed therethrough, wherein the diameter of said first aperture is substantially equal to the outer diameters of both said first continuous inner conductor and said second continuous inner conductor so as to allow each said circular disc to fit snugly around said inner conductors, wherein the diameter of said second aperture is substantially equal to the outer diameters of said outer conductors in both said first plurality of outer conductors and said second plurality of outer conductors so as to allow each said circular disc to fit snugly around said outer conductors, and wherein said first and second apertures are tangent to each other.

8. The improved coaxial-collinear antenna defined in claim 7, further comprising a radome enclosing said continuous inner conductors, said outer conductors, and said dielectric supports, wherein the outer diameter of each said circular disc is substantially equal to the inner diameter of said radome so as to allow each said circular disc to fit snugly within said radome and thereby support said radome.

9. An improved coaxial-collinear antenna comprising:

a first continuous inner conductor having a first plurality of dielectric spacers mounted thereon for supporting a first plurality of individual outer conductors in coaxial alignment with said first continuous inner conductor, each said outer conductor in said first plurality of outer conductors being equidistantly spaced along said first continuous inner conductor by an amount substantially equal to the length of one of said outer conductors; and a second continuous inner conductor having a second plurality of dielectric spacers mounted thereon for supporting a second plurality of individual outer conductors in coaxial alignment with said second continuous inner conductor, each said outer conductor in said second plurality of outer conductors being equidistantly spaced along said second continuous inner conductor by an amount substantially equal to the length of one of said outer conductors;

said first and second continuous inner conductors being parallel, each said outer conductor in said first plurality of outer conductors being electrically connected to said second continuous inner conductor between consecutively spaced outer conductors in said second plurality of outer conductors, each said outer conductor in said second plurality of outer conductors being electrically connected to said first continuous inner conductor between consecutively spaced outer conductors in said first plurality of outer conductors.

10. The improved coaxial-collinear antenna defined in claim 9, wherein said first and second pluralities of dielectric spacers comprise annularly shaped dielectric discs each having an aperture formed through the center thereof wherein the diameter of each aperture is substantially equal to the outer diameters of both said first continuous inner conductor and said second continuous inner conductor so as to allow each said annular disc to fit snugly around said inner conductors.

11. The improved coaxial-collinear antenna defined in claim 10, wherein the outer diameter of each said annularly shaped dielectric disc is substantially equal to the inner diameters of said outer conductors in both said first plurality of outer conductors and said second plurality of outer conductors so as to allow each said annular disc to fit snugly within said outer conductors.

12. The improved coaxial-collinear antenna defined in claim 10, wherein each said annularly shaped dielectric disc has a stepped outer diameter, wherein a first portion of each said annular disc has an outer diameter that is substantially equal to the inner diameters of said outer conductors in both said first plurality of outer conductors and said second plurality of outer conductors so as to allow said first portion of each said annular disc to fit snugly within said outer conductors, and wherein a second portion of each said annular disc has an outer diameter that is substantially equal to or less than the outer diameters of said outer conductors in both said first plurality of outer conductors and said second plurality of outer conductors so as to allow said second portion of each said annular disc to sit flush with or below the outer diameters of said outer conductors and thereby allow said outer conductors to be tangentially electrically connected to said inner conductors.

13. The improved coaxial-collinear antenna defined in claim 9, further comprising a plurality of dielectric supports, wherein each said dielectric support is disposed around one of said continuous inner conductors and connected one of said outer conductors so as to sustain a tangential electrical connection between said continuous inner conductor and said one outer conductor.

14. The improved coaxial-collinear antenna defined in claim 13, wherein said plurality of dielectric supports comprise circularly shaped dielectric discs each having a first aperture and a second aperture formed therethrough, wherein the diameter of said first aperture is substantially equal to the outer diameters of both said first continuous inner conductor and said second continuous inner conductor so as to allow each said circular disc to fit snugly around said inner conductors, wherein the diameter of said second aperture is substantially equal to the outer diameters of said outer conductors in both said first plurality of outer conductors and said second plurality of outer conductors so as to allow each said circular disc to fit snugly around said outer conductors, and wherein said first and second apertures are tangent to each other.

15. The improved coaxial-collinear antenna defined in claim 14, further comprising a radome enclosing said continuous inner conductors, said outer conductors, said dielectric spacers, and said dielectric supports, wherein the outer diameter of each said circular disc is substantially equal to the inner diameter of said radome so as to allow each said circular disc to fit snugly within said radome and thereby support said radome.

* * * * *